US005195660A

United States Patent [19]

Lekes

[11] Patent Number: 5,195,660

[45] Date of Patent: Mar. 23, 1993

[54] CLAMPING TYPE CAULKING GUN

[76] Inventor: Joseph A. Lekes, 3415 Pico Dr., Tampa, Fla. 33614

[21] Appl. No.: 811,614

[22] Filed: Dec. 23, 1991

[51] Int. Cl.[5] ..... B65D 35/28

[52] U.S. Cl. ..... 222/103; 222/105; 222/214

[58] Field of Search ..... 222/103, 105, 323, 79, 222/214

[56] References Cited

U.S. PATENT DOCUMENTS

| | | | |
|---|---|---|---|
| 859,711 | 7/1907 | Winsor | 222/103 |
| 2,880,911 | 4/1959 | Robertson | 222/105 |
| 3,675,822 | 7/1972 | Casali et al. | 222/103 |
| 4,581,021 | 4/1986 | Landau et al. | 222/105 |

FOREIGN PATENT DOCUMENTS

| | | | |
|---|---|---|---|
| 1335606 | 7/1963 | France | 222/105 |

*Primary Examiner*—Andres Kashnikow
*Assistant Examiner*—Philippe Derakshani
*Attorney, Agent, or Firm*—Dominik, Stein, Saccocio, Reese, Colitz & Van Der Wall

[57] ABSTRACT

A device for dispensing fluid from a tube, the tube being of the type having a slot at the rear end and an apertured nozzle at the front end, the device comprising a handle with an upper support surface; a trigger pivotally secured to the handle; a fixed pressure plate secured to the support surface for receiving a tube, a rear vertical flange designed with horizontal slots acting as pivot points and a front vertical flange with an aperture for receiving a tube nozzle; a movable pressure plate having a rearwardly extending projection for engagement in the horizontal slots; and a coupling mechanism formed of a wire in an inverted U-shaped configuration with free ends coupled to the trigger and with an upper central extent positionable on the upper surface of the moveable pressure plate whereby squeezing the trigger with respect to the handle will cause the two plates to move together to compress a tube between the two plates and dispense the fluid from the tube.

5 Claims, 3 Drawing Sheets

CLAMPING TYPE CAULKING GUN

BACKGROUND OF THE INVENTION

1. Field of the Invention

The present invention relates to a caulk dispenser, and more particularly, to apparatus for supporting and squeezing a tube containing a fluid material to effect the dispensing thereof in a convenient, accurate and efficient manner.

2. Description of the Background Art

A common product used in home repair is caulk. Caulk is an adhesive fluid applied along a line at the interface of building components to seal the line and preclude the flow of water, air and other fluids therethrough. Various devices have been used to contain caulk. Various devices have also been used to dispense caulk from their containers.

One common technique for containing caulk, particularly for the home user market, is a tube of a flexible material with a nozzle at one end. With the nozzle placed adjacent to one end of a line to be caulked, the user simply squeezes the tube to force it out of the tube while moving the nozzle and tube at a constant speed along the line to be caulked. Such an application method is very common. Unfortunately, however, skill is needed by the user in order to effect a smooth continuous flow of the caulking material from the tube to the line being sealed.

Various devices have been designed and sold to assist the user in dispensing caulk from tubes. Many such devices are disclosed in the patent literature. The large number of patents is evidence of the fact that an optimal solution has not yet been devised. By way of background, consider U.S. Pat. No. 2,723,050 to Montgomery; 2,772,026 to Harrington; 2,936,097 to Loria; and 4,172,536 to Holt.

The patent to Montgomery relates to a scissors like device for supporting a tube whose contents are to be dispensed. It is particularly applicable to tubes containing a medicinal preparation such as certain antibiotics or other pharmacuticals including those used in the dairy industry. The accurate placement of the dispensed contents is difficult due to the scissor like arrangement of the handle.

In Harrington, a collapsible tube squeezer is disclosed. The apparatus is a complex arrangement of parts particularly designed for the dispensing of colors from tubes for the intermixing and creation of unique colors. A multiplicity of parts including springs, cams, leavers, etc. makes the construction expensive and the use difficult rendering it inadequate for the convenience home market.

In the patent to Loria, there is disclosed a gun shaped device particularly adapted for enticing children to use toothpaste. The gun barrel supports the tube and therebeneath a complex arrangement of springs, ratchets and other components sets forth a complex arrangement, difficult to manufacture and difficult to use.

The last patent of interest, that to Holt, relates to a dispenser for toothpaste and the like. It relies simply on a pair of rigid plates fixedly positioned with respect to each other at one end but moveable at the dispensing end between open and closed positions. A separate apertured plate supports the nozzle. No mechanisms for accurate dispensing is contemplated or disclosed.

As can be readily seen, the background art discloses a wide variety of devices designed for dispensing contents from tubes. Such devices are fabricated in a wide variety of designs. No background art, however, discloses, teaches or suggests a device for dispensing caulk as conveniently or as accurately or as efficiently as disclosed herein.

As illustrated by the background art, efforts are continuously being made to improve, dispensing devices. No prior reference, however, suggest the present inventive combination of component elements arranged and configured as disclosed herein. Prior devices do not provide the benefits attendant with the present invention. The present invention achieves its purposes, objects and advantages over the prior art through a new, useful and unobvious combination of component elements, through the use of a minimum number of functioning parts, through the utilization of readily available materials and conventional components, all with a reduction in cost.

It is therefor an object of the present invention to provide a device for dispensing fluid from a tube, the tube being of the type having a slot at the rear end and an apertured nozzle at the front end, the device comprising a handle with an upper support surface; a trigger pivotally secured to the handle; a fixed pressure plate secured to the support surface for receiving a tube, a rear vertical flange designed with horizontal slot means acting as pivot points and a front vertical flange with an aperture for receiving a tube nozzle; a movable pressure plate having a rearwardly extending projection for engagement in the horizontal slot means; and a coupling mechanism formed of a wire in an inverted U-shaped configuration with free ends coupled to the trigger and with an upper central extent positionable on the upper surface of the moveable pressure plate whereby squeezing the trigger with respect to the handle will cause the two plates to move together to compress a tube between the two plates and dispense the fluid from the tube.

It is a further option to the present invention to conveniently dispense caulk from tubes.

It is a further object of the present invention to accurately place caulk along a line to be caulked.

Lastly, it is an object of the present invention to apply smooth and continuous pressures to caulk in a tube for the efficient dispensing thereof with minimum training.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The present invention is defined by the appended claims with the specific embodiment shown in the attached drawings. For the purpose of summarizing the invention, the invention may be incorporated into an apparatus for dispensing caulk from a tube of the type having a slot at the rear end and an apertured nozzle at the front end, the apparatus comprising a handle having an upper support surface; a trigger pivotally secured with respect to the handle; a fixed pressure plate having its lower face secured to the upper support surface for retaining a tube of caulk thereon, the fixed pressure plate having an upturned flange at the rear end with a lower slot in a generally horizontal orientation formed therein and an upper slot in a generally horizontal orientation formed therein above the lower slot, the fixed pressure plate having an upturned flange at the front end for receiving the nozzle of the tube, the fixed pressure plate having a transverse bend formed in a central extent thereof; a pivotable pressure plate having a projection at the rear end positionable in one of the slots to form a pivot point, the pivotable pressure plate also having a pair of upwardly extending stops formed on the upper surface thereof and longitudinally spaced along the length thereof; and a squeeze wire formed in a generally inverted U shaped configuration with free ends at their lower extents positionable in apertures of the trigger for arcuate movement therewith, the squeeze wire having a central extent positionable on the upper surface of the pivotable pressure plate adjacent to the stops whereby squeezing of the trigger with respect to the support base will effect the lowering of the squeeze wire and the movement of the pivotable pressure plate towards the fixed pressure plate to compress a tube of caulk therebetween for dispensing the caulk.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be made to the accompanying drawings in which.

The same reference numerals refer to same parts throughout the several figures.

DETAILED DESCRIPTION OF THE PREFERRED EMBODIMENT

Figure 1:
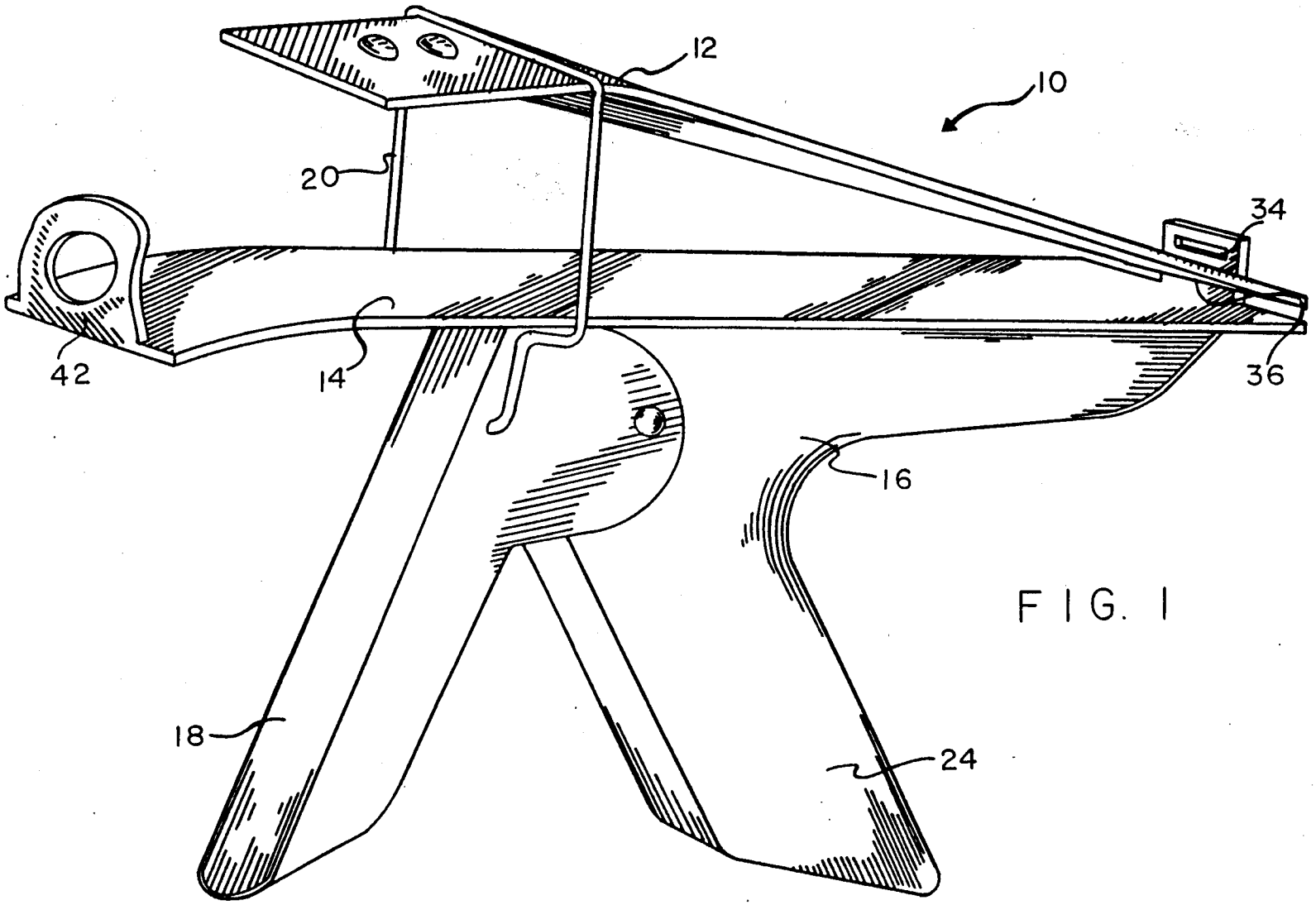
FIG. 1 is a perspective illustration of a caulk dispensing device constructed in accordance with the principle of the present invention.
Figure 2:
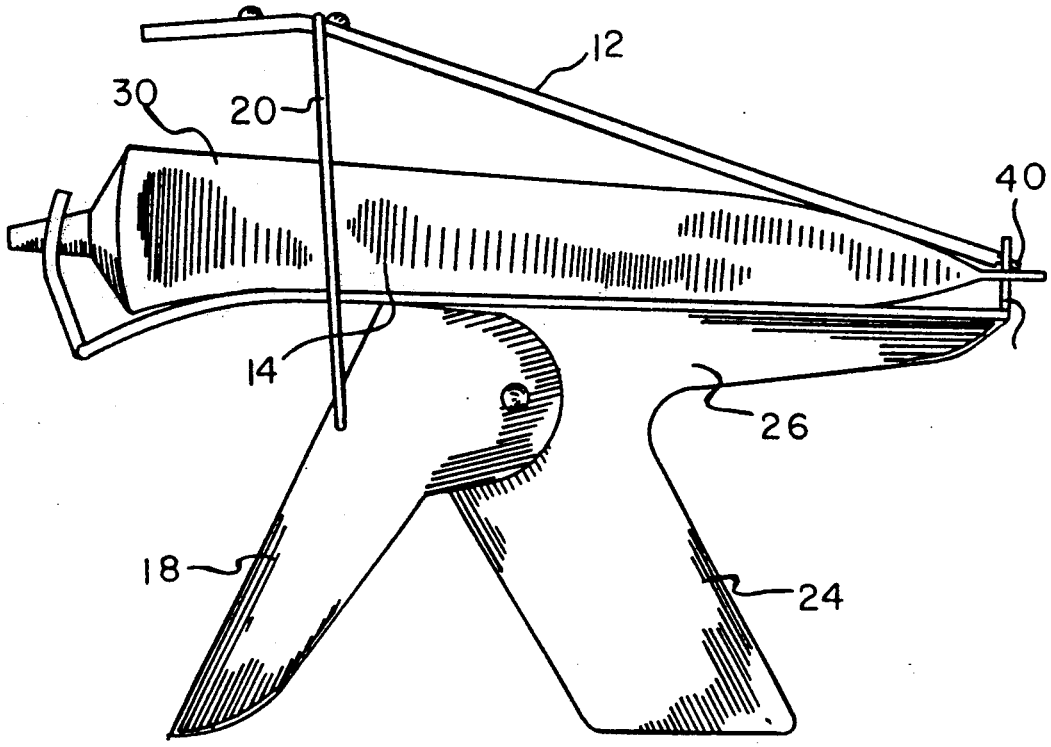
FIGS. 2 through 5 are side elevational views of the device of FIG. 1 illustrating the sequential dispensing of caulk from the tube.
Figure 3:
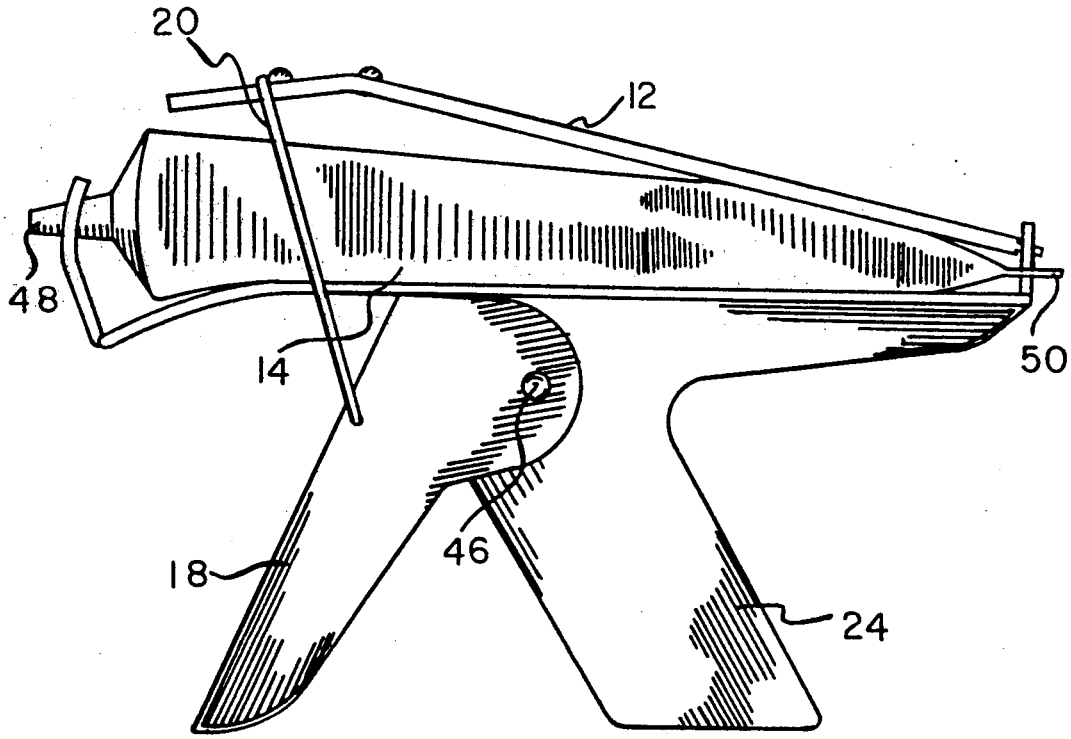

Shown in FIGS. 1 through 5, with particular reference to FIG. 1, is a device 10 for dispensing caulk from a tube. It could aptly be described as a tube gun. The device 10 is composed of five basic elements: A moveable pressure plate 12, a fixed pressure plate 14, a support base 16, a trigger 18 and a coupling mechanism 20.

The support base 16 is composed of a handle 24 and an upper flat support surface 26 for receiving the fixed pressure plate 14 which acts as a platen to secure the dispensing tube 30 of caulk. The rear end of the fixed support plate 14 has a rear flange 32 that incorporates two horizontal slots 34 and 36 which accepts a projection 40 at the rear end of the moveable pressure plate 12 and act as a pivot point in the operation of the device 10. The forward end of this fixed pressure plate 14 has an aperture 42 that accepts the nozzle 48 of the tube 30 of caulk.

The trigger 18 is pivotally coupled to the handle 24 by a pin 46 and rotates on this pin in the operation of the gun.

The coupling mechanism 20 connects the trigger 18 with the moveable pressure plate 12 and effects the operation of the device 10.

The moveable pressure plate 12 acts as a press by exerting force upon the tube 30 of caulk.

In operation and use the handle 24 is gripped in the palm of the hand, the fingers extend around the trigger 18. Pulling the fingers to the rear squeezes the handle 24 causing the coupling mechanism 20 to exert pressure on movable pressure plate 12. This applied pressure causes the movable pressure plate to pivot at its projection 40 and compress the two plates 12 and 14 together.

In this manner a supported tube 30 is squeezed for the dispensing of caulk as will be described. Release of the trigger 18 allows resilience of the tube 30 to expand and thus return the trigger 18 to the forward extended position.

It is intended that the dispensing method of this present invention be used with a conventional tube 30 of caulk. The caulk is a standard item of commerce as is the tube. The tube is elastomeric and when squeezed will expel its contents. When released, the tube will resile and return to its initial shape. Note FIGS. 2 and 3. It is this action that returns the trigger 18 to its initial position away from the handle 24. The tube 30 is normally six fluid ounces, with a nozzle 48 at the forward end and a slotted tab 50 at the rearward end. Tube size can vary but the function remains the same. Tubes of this nature are on the market today.

Secured to the upper surface of the handle 24 is the fixed pressure plate 14. Depending upon method of manufacture they may be either bolted, welded or molded together. All parts are formed of a rigid material so as to maintain their shape during repeated use. The fixed pressure plate 14 has a traverse bend 54 extending laterally across its width near the forward end, along with an upturned flange 56 with an aperture 42 for locating the tube nozzle 48 during installation and operation. At the rear end of the fixed pressure plate 14 is a vertical projection 32 with two lateral slots 34 and 36 positioned horizontally one above the other. This vertical projection 32 serves two purposes: first to secure the tube 30 on the fixed pressure plate 14 through tab 50 and second to provide a pivot point for the moveable pressure plate 12 during operation.

Figure 4:
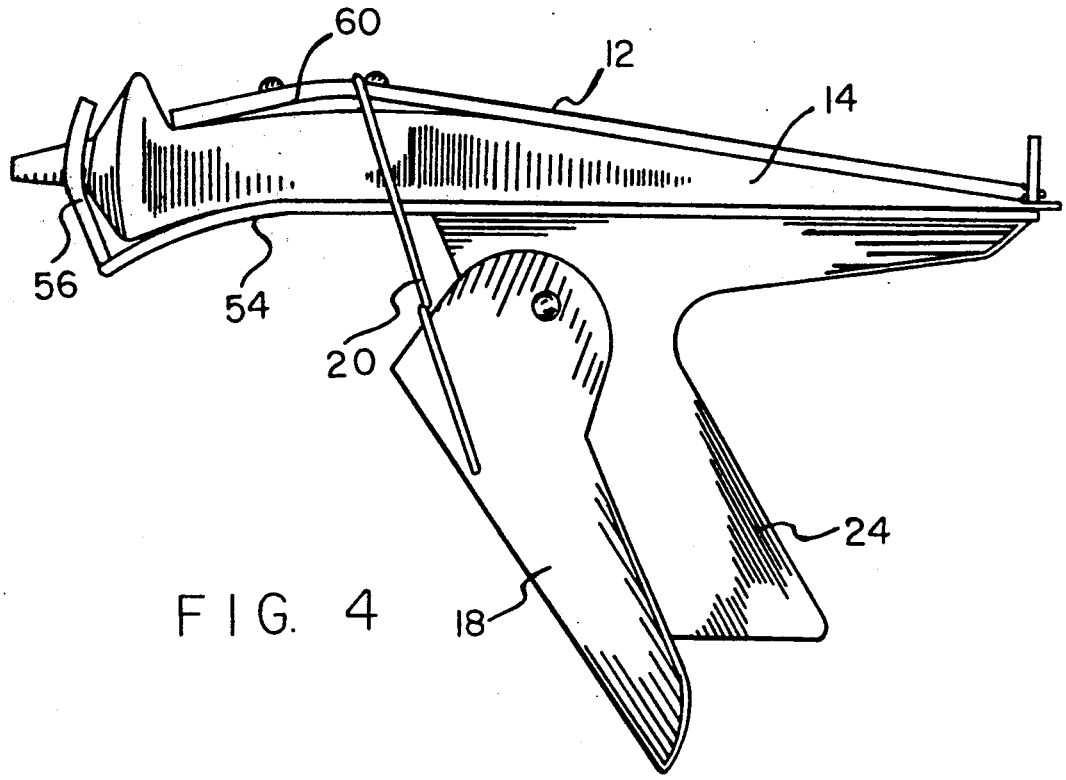
Figure 5:
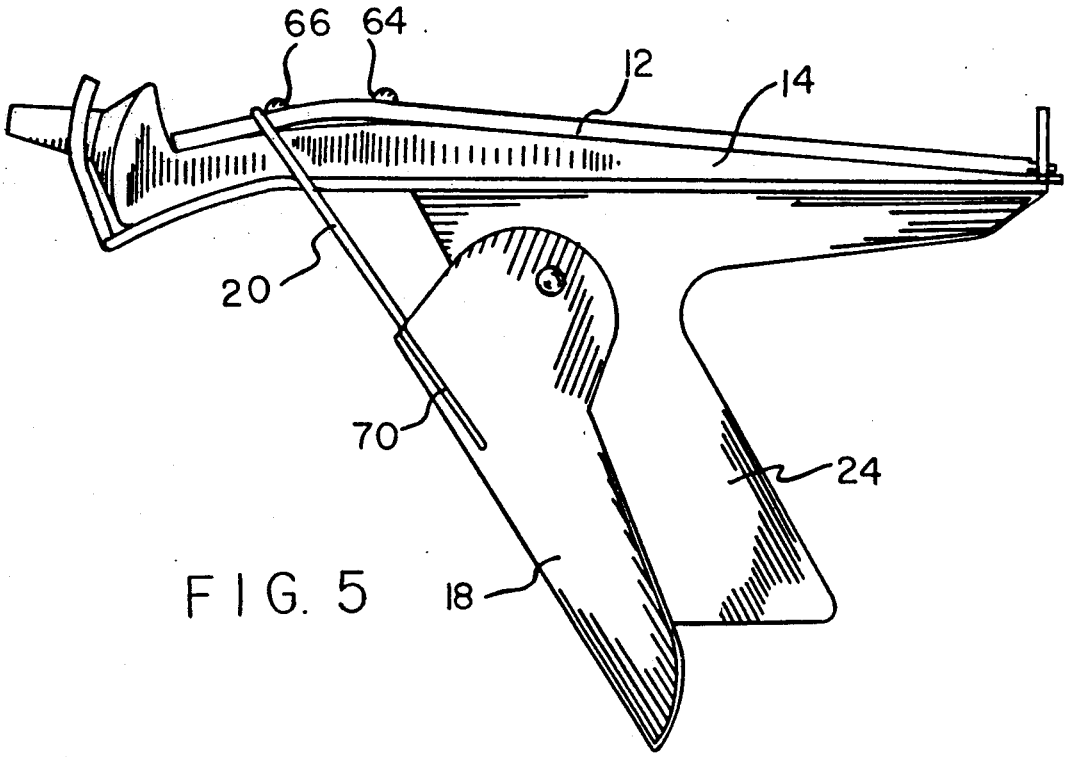

The moveable pressure plate 12 is positioned above the fixed pressure plate 14 and acts in concert with the fixed pressure plate 14 to dispense the caulk. This moveable pressure plate 12 also has a traverse bend 60 near its forward end and conforms with the corresponding bend 54 in the fixed pressure plate 14. At the rear of the fixed pressure plate 14 is a flange 32. At the rear end of the movable pressure plate 12 is a projection 40. This projection 40 corresponds in size with the two slots 34 and 36 provided in the rear vertical flange 32. In operation the upper slot 34 is engaged first by projection 40 so as to receive a full tube 30 of caulk without applying pressure but ready to exert such when ready to begin operation. Note FIG. 2. The lower slot 36 is engaged after exhausting the compression range of the upper slot 34. This repositioning allows final evacuation of the tube contents as illustrated in FIGS. 4 and 5.

Formed on the upper surface of the moveable pressure plate 12 are upward stops 64 and 66 which are located forward of the midpoint of the movable pressure plate 12. These stops act as moveable anchor points for the coupling mechanism 20 during operation of the device. These stops may extend across the surface of the movable pressure plate and may be incorporated by any convenient technique during fabrication of the movable pressure plate.

The last component of the device is the coupling mechanism 20. It is a wire in a generally inverted U-shaped configuration. Its lower free ends 70 are designed to couple with the trigger 18 forward of the trigger pivot point. Positioned such, when the handle 24 is squeezed, it causes this mechanism to move up and down in turn moving the movable pressure plate 12 up and down. Mechanical advantage is gained through the use of upward stops 64 and 66 on the moveable pressure plate by allowing a shift of pressure points and thus maintaining equalized force in compressing the tube 30 of caulk between the two plates. Equalizing the pressure assures a smooth dispensing action.

The design of the present invention is user friendly in that no prior experience is needed. It provides for accurate aiming and controlled flow by the user with lessened fatigue.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. Apparatus for dispensing caulk from a tube of the type having a slot at the rear end and an apertured nozzle at the front end, the apparatus comprising:

a handle having an upper support surface;

a trigger pivotally secured with respect to the handle;

a fixed pressure plate having its lower face secured to the upper support surface for retaining a tube of caulk thereon, the fixed pressure plate having an upturned flange a the rear end with a lower slot in a generally horizontal orientation formed therein and an upper slot in a generally horizontal orientation formed therein above the lower slot, the fixed pressure plate having an upturned flange at the front end for receiving the nozzle of the tube, the fixed pressure plate having a transverse bend formed in a central extent thereof;

a pivotable pressure plate having a projection at the rear end positionable in one of the slots to form a pivot point, the pivotable in one of the slots to form a pivot point, the pivotable pressure plate also having a pair of upwardly extending stops formed on the upper surface thereof and longitudinally spaced along the length thereof; and a squeeze wire formed in a generally inverted U shaped configuration with fixed ends at their lower extents positionable in apertures of the trigger for arcuate movement therewith, the squeeze wire having a central extent positionable on the upper surface of the pivotable pressure plate adjacent to the stops whereby squeezing of the trigger with respect to the support base will effect the lowering of the squeeze wire and the movement of the pivotable pressure plate towards the fixed pressure plate to compress a tube of caulk.

2. A device for dispensing fluid from a tube, the tube being of the type having a slot at the rear end and an apertured nozzle at the front end, the device comprising:

a handle with an upper support surface;

a trigger pivotally secured to the handle;

a fixed pressure plate secured to the support surface for receiving a tube, the fixed pressure plate having a rear vertical flange and a front vertical flange, the rear vertical flange designed with horizontal slot means and the front vertical flange having an aperture for receiving a tube nozzle;

a movable pressure plate having a rearwardly extending projection for engagement in the horizontal slot means; and a coupling mechanism formed of a wire in an inverted U-shaped configuration with fixed ends coupled to the trigger and with an upper central extent positionable on the upper surface of the moveable pressure plate whereby squeezing the trigger with respect to the handle will cause the two plates to move together to compress a tube between the two plates and dispense the fluid from the tube.

3. The device as set forth in claim 2 wherein the plates have corresponding bends to insure the complete dispensing of the fluid from the tube when squeezed.

4. The device as set forth in claim 2 and further including stops on the upper surface of the movable pressure plate for locating the coupling mechanism.

5. The device as set forth in claim 2 wherein the slot means includes two horizontal slots, one above the other.

* * * * *

UNITED STATES PATENT AND TRADEMARK OFFICE

CERTIFICATE OF CORRECTION

PATENT NO. : 5,195,660

DATED : March 23, 1993

INVENTOR(S) : Joseph A. Lekes

It is certified that error appears in the above—identified patent and that said Letters Patent is hereby corrected as shown below:

In column 6, lines 7 and 8, delete "the pivotable in one of the slots to form a pivot point,".

Signed and Sealed this

Twelfth Day of April, 1994

Bruce Lehman

BRUCE LEHMAN

*Commissioner of Patents and Trademarks*

*Attest:*

*Attesting Officer*